US008753144B2

(12) United States Patent
Nakamura et al.

(10) Patent No.: US 8,753,144 B2
(45) Date of Patent: Jun. 17, 2014

(54) CONNECTOR ASSEMBLY HAVING INSULATING MATERIAL WITH DIFFERENT DIELECTRIC CONSTANT

(75) Inventors: Hajime Nakamura, Sakura (JP); Sho Ueda, Sakura (JP); Yoshinori Satou, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/601,833

(22) Filed: Aug. 31, 2012

(65) Prior Publication Data

US 2012/0322278 A1 Dec. 20, 2012

Related U.S. Application Data

(63) Continuation of application No. PCT/JP2011/050317, filed on Jan. 12, 2011.

(30) Foreign Application Priority Data

Mar. 1, 2010 (JP) ..... 2010-043835

(51) Int. Cl.
*H01R 12/24* (2006.01)

(52) U.S. Cl.
USPC ..... 439/493; 439/607.46

(58) Field of Classification Search
USPC ..... 439/81, 493, 497, 607.41, 607.42, 439/607.46, 607.47
See application file for complete search history.

(56) References Cited

U.S. PATENT DOCUMENTS

| | | | | |
|---|---|---|---|---|
| 5,660,551 | A | 8/1997 | Sakurai | |
| 7,462,071 | B1 * | 12/2008 | Wu | 439/607.05 |
| 8,039,746 | B2 * | 10/2011 | Ashida et al. | 174/88 R |
| 8,246,387 | B2 * | 8/2012 | Fjelstad | 439/638 |
| 2005/0255741 | A1 * | 11/2005 | Ashida et al. | 439/492 |
| 2006/0228935 | A1 * | 10/2006 | Wen et al. | 439/497 |
| 2008/0050950 | A1 * | 2/2008 | Wu | 439/108 |
| 2009/0197459 | A1 * | 8/2009 | Yu et al. | 439/497 |
| 2009/0264011 | A1 * | 10/2009 | Wang | 439/507 |
| 2009/0305521 | A1 * | 12/2009 | Yang et al. | 439/56 |
| 2010/0055973 | A1 * | 3/2010 | Yang et al. | 439/490 |
| 2010/0184329 | A1 * | 7/2010 | Hou et al. | 439/607.01 |

FOREIGN PATENT DOCUMENTS

| | | | |
|---|---|---|---|
| JP | 61-156645 | A | 7/1986 |
| JP | 07-122335 | A | 5/1995 |
| JP | 11-238415 | A | 8/1999 |
| JP | 2004-015822 | A | 1/2004 |
| JP | 2006-216348 | A | 8/2006 |
| WO | 2004/015822 | A1 | 2/2004 |

OTHER PUBLICATIONS

Japanese Office Action dated Dec. 24, 2013 issued in Japanese Patent Application No. 2010-043835.

* cited by examiner

*Primary Examiner* — Hae Moon Hyeon
(74) *Attorney, Agent, or Firm* — Sughrue Mion, PLLC

(57) ABSTRACT

A connector assembly (1) includes a connector (10) including contact terminals (11), a cable (20) having conductors (221), and a wiring board (30) which electrically connects the connector (10) and the cable (20). The wiring board (30) includes first connecting portions (32) which are arranged at a first pitch ($P_1$) and to which the contact terminals (11) are electrically connected, second connecting portions (33) which are arranged at a second pitch ($P_2$) and to which the conductors (221) of the cable (20) are electrically connected, and wiring lines (34) which electrically connect the first connecting portions (32) and the second connecting portions (33). The first pitch ($P_1$) is smaller than the second pitch ($P_2$).

8 Claims, 13 Drawing Sheets

CONNECTOR ASSEMBLY HAVING INSULATING MATERIAL WITH DIFFERENT DIELECTRIC CONSTANT

TECHNICAL FIELD

The present invention relates to a connector assembly in which a cable and a connector are electrically connected via a wiring board.

The present application claims priority from Japanese Patent Application No. 2010-043835 filed on Mar. 1, 2010 and International Application PCT/JP2011/50317 filed on Jan. 12, 2011. The contents described and/or illustrated in the documents relevant to the Japanese Patent Application No. 2010-043835 and International Application PCT/JP2011/50317 will be incorporated herein by reference as a part of the description and/or drawings of the present application.

BACKGROUND ART

An electrical connector in which connection terminals disposed in a connector housing and conductors of a cable are directly connected is known (for example, refer to Patent Literature 1).

CITATION LIST

Patent Literature

Patent Literature 1: International Patent Laid-Open No. 2004-015822

DISCLOSURE OF THE INVENTION

Problem to be Solved by the Invention

In the electrical connector described above, since the connection between the connection terminals and the conductors is realized by soldering or spot welding, it is necessary to secure a sufficient pitch between connection terminals in order to suppress short-circuiting between adjacent connection terminals. As a result, the electrical connector has a large size.

An object of the present invention is to provide a connector assembly capable of decreasing the size of a connector.

Means for Solving Problem

A connector assembly according to the present invention is a connector assembly comprising: a connector including contact terminals; a cable including conductors; and a wiring board which electrically connects the connector and the cable, wherein the wiring board includes: first connecting portions which are arranged at a first pitch and to which the contact terminals are electrically connected; second connecting portions which are arranged at a second pitch and to which the conductors of the cable are electrically connected; and wiring lines which electrically connect the first connecting portions and the second connecting portions, and the first pitch is smaller than the second pitch.

In the above-mentioned invention, the cable may include a cable exposed portion in which insulating wires including the conductors are exposed from a cable shielding layer and the conductors are exposed from the insulating wires, the connector assembly may further comprise: a connector shielding layer which is provided around the wiring board and the cable exposed portion; and an insulating material which is interposed between the connector shielding layer and the wiring board and which is interposed between the connector shielding layer and the cable exposed portion, a dielectric constant of a first portion of the insulating material may be different from a dielectric constant of a second portion of the insulation material, the first portion may surround the first connecting portions in the insulating material, and the second portion may surrounds the second connecting portions in the insulating material.

In the above-mentioned invention, the first portion of the insulating material may comprise a hot melt and a foam, and the second portion of the insulating material may comprise the hot melt.

In the above-mentioned invention, the first portion of the insulating material may comprise a first hot melt, and the second portion of the insulating material may comprise a second hot melt which has a dielectric constant different from that of the first hot melt.

In the above-mentioned invention, the second portion may include: a third portion which surrounds the second connecting portions; and a fourth portion which is adjacent to the third portion and which surrounds the cable exposed portion, and a dielectric constant of the third portion of the insulating material may be different from a dielectric constant of the fourth portion of the insulating material.

In the above-mentioned invention, the insulating material may include a solid insulating material and a gaseous insulating material, the gaseous insulating material may be interposed between the solid insulating material and the connector shielding layer, or the gaseous insulating material may be interposed between the solid insulating material and the wiring board and is interposed between the solid insulating material and the cable exposed portion, and a thickness of the first portion of the solid insulating material may be different from a thickness of the second portion of the solid insulating material.

In the above-mentioned invention, the second portion may include: a third portion which surrounds the second connecting portions; and a fourth portion which is adjacent to the third portion and which surrounds the cable exposed portion, and a thickness of the third portion of the solid insulating material may be different from a thickness of the fourth portion of the solid insulating material.

A connector assembly according to the present invention is a connector assembly comprising: a connector; a cable including a cable exposed portion in which insulating wires including conductors is exposed from a cable shielding layer and the conductors are exposed from the insulating wires; a wiring board which electrically connects the connector and the cable; a connector shielding layer which is provided around the wiring board and the cable exposed portion; and an insulating material which is interposed between the connector shielding layer and the wiring board and which is interposed between the connector shielding layer and the cable exposed portion, wherein the wiring board includes: first connecting portions to which the connector is electrically connected; second connecting portions to which the conductors of the cable are electrically connected, and wiring lines which electrically connect the first connecting portions and the second connecting portions, and a distance from the connector shielding layer to the first connecting portions is different from a distance from the connector shielding layer to the second connecting portions and the cable exposed portion.

In the above-mentioned invention, a distance from the connector shielding layer to the second connecting portions may be different from a distance from the connector shielding layer to the cable exposed portion.

Effect of Invention

According to the present invention, since the first pitch of the first connecting portions of the wiring board, to which the contact terminals are electrically connected, is smaller than the second pitch of the second connecting portions to which the conductors are electrically connected, it is possible to decrease the size of the connector.

BEST MODE(S) FOR CARRYING OUT THE INVENTION

Hereinafter, embodiments of the present invention will be described based on the drawings.

<<First Embodiment>>

Figure 1:
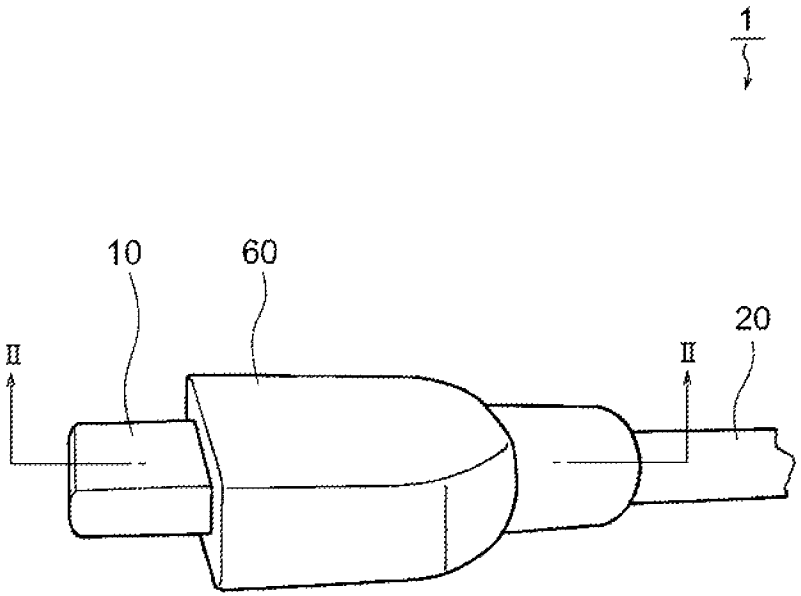
FIG. 1 is a perspective view of a connector assembly in a first embodiment of the present invention.
Figure 2:
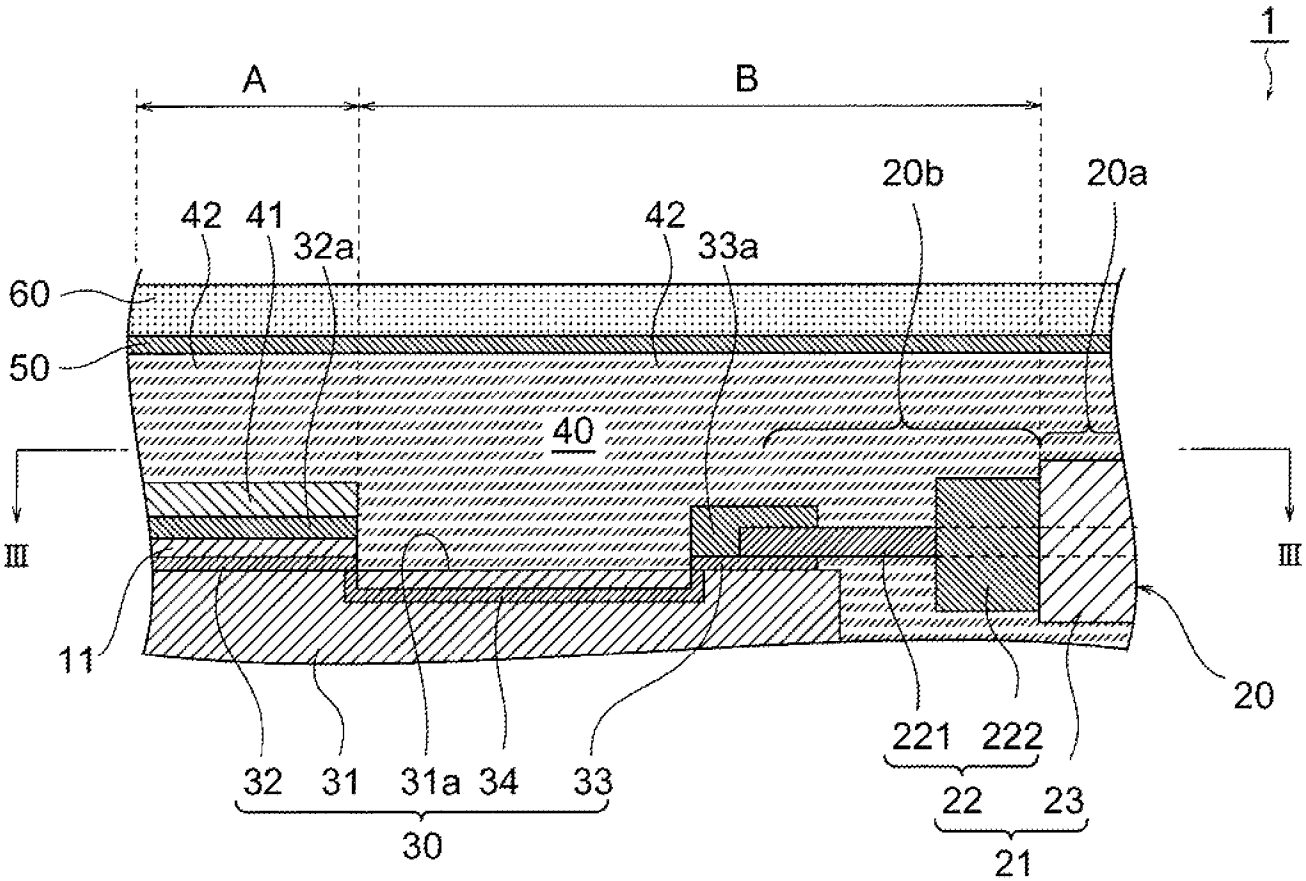
FIG. 2 is a cross-sectional view along the line II-II of FIG. 1.
Figure 3:
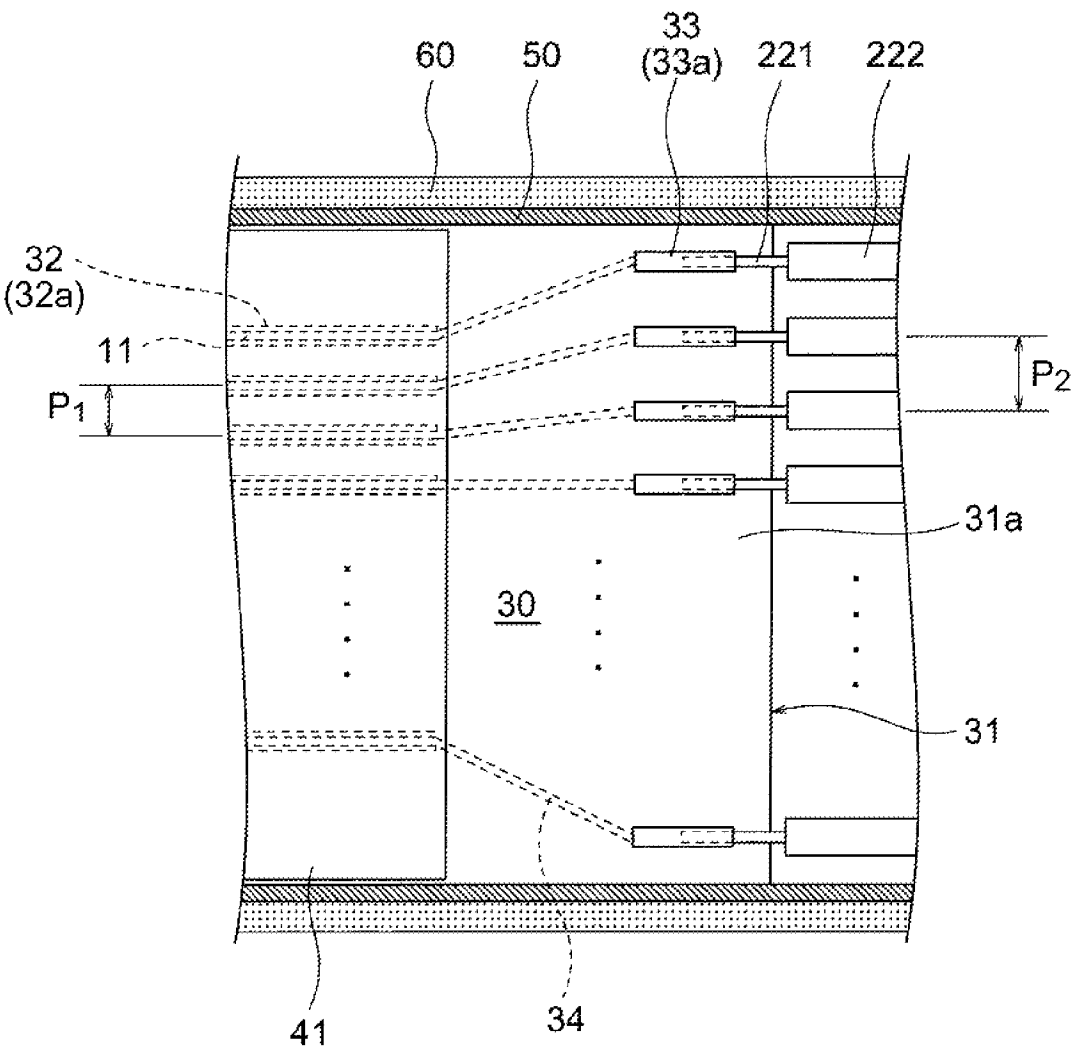
FIG. 3 is a cross-sectional view along the line III-III of FIG. 2.
Figure 4:
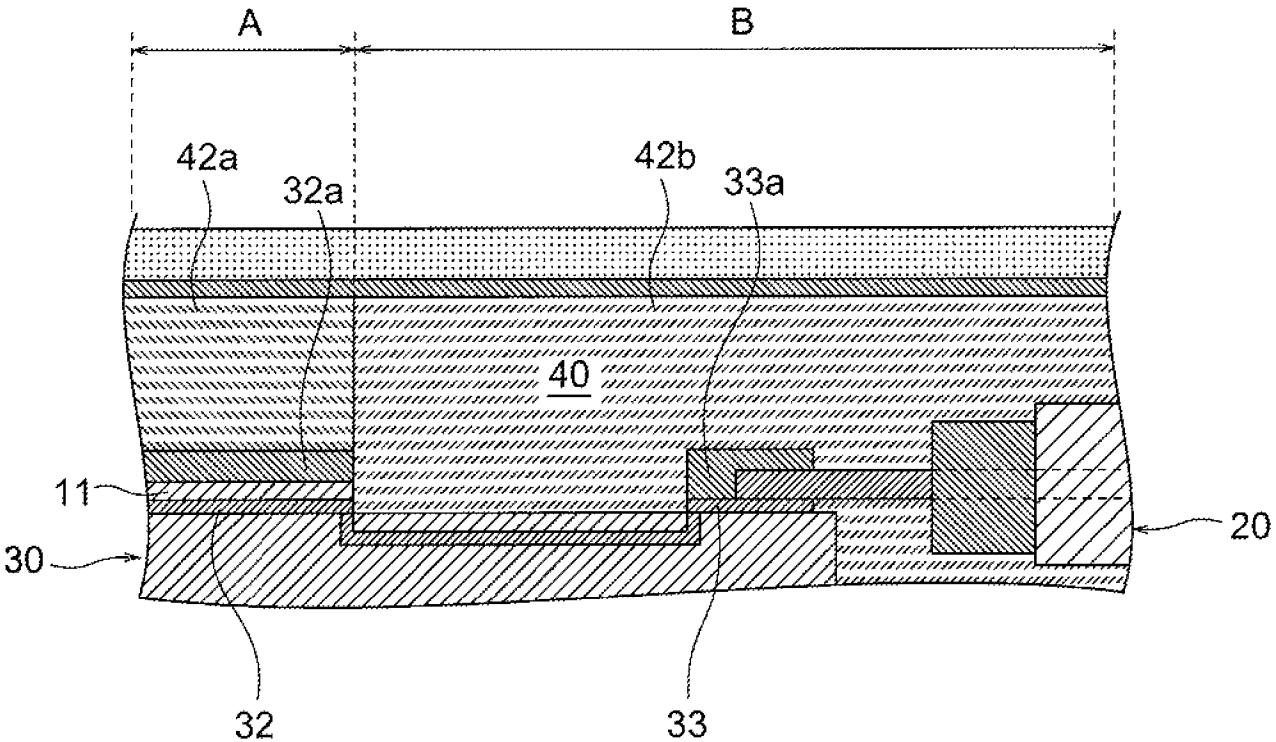
FIG. 4 is a cross-sectional view illustrating a first modification example of the connector assembly in the first embodiment of the present invention.
Figure 5:
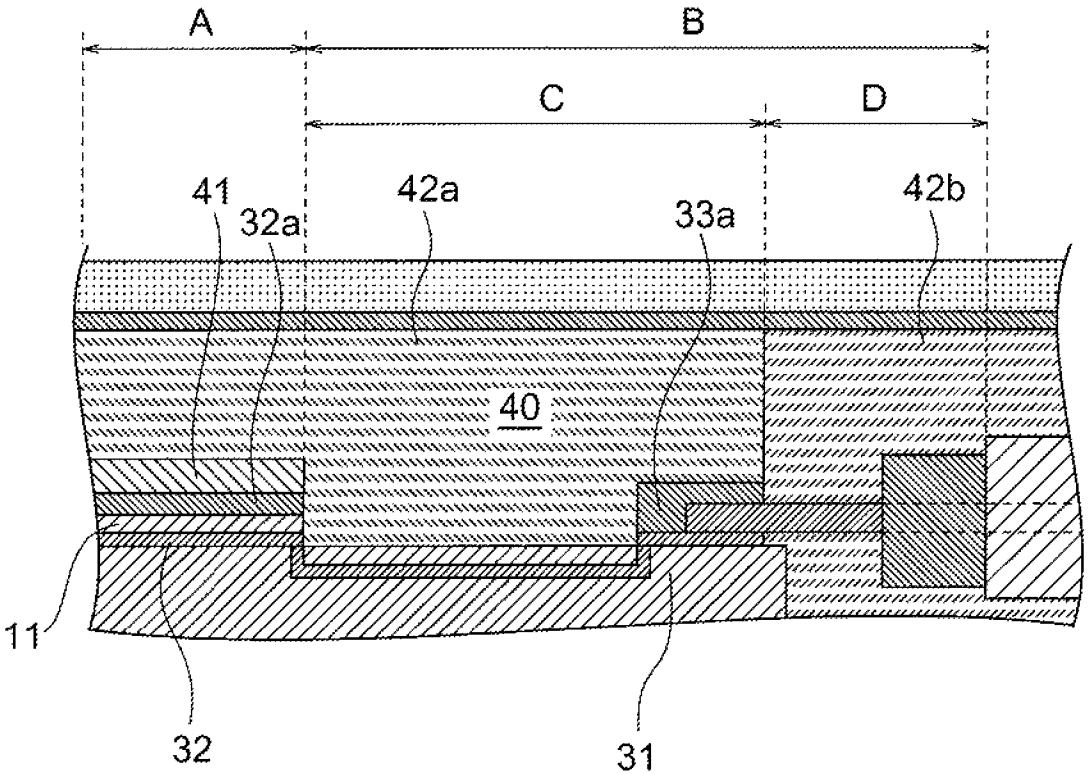
FIG. 5 is a cross-sectional view illustrating a second modification example of the connector assembly in the first embodiment of the present invention.

FIG. 1 is a perspective view of a connector assembly in the present embodiment, FIG. 2 is a cross-sectional view along the line II-II of FIG. 1, FIG. 3 is a cross-sectional view along the line III-III of FIG. 2, and FIGS. 4 and 5 are cross-sectional views illustrating the modification examples of the connector assembly in the present embodiment.

The connector assembly 1 of the present embodiment has a configuration in which a transmission cable compliant with the High-Definition Multimedia Interface (HDMI: registered trademark) standards, for example, is connected to a connector. The connector assembly 1 is used when electrically connecting electronic apparatuses such as a television and a PC. The connector assembly 1 may be applied to Universal Serial Bus (USB) 3.0 connectors and Display Port connectors.

The connector assembly 1 of the present embodiment comprises a connector 10, a cable 20, a wiring board 30, an insulating material 40, a connector shielding layer 50, and an insulating cover layer 60, as illustrated in FIGS. 1 and 2.

The connector 10 is fitted to another connector (for example, a HDMI terminal) corresponding to the connector assembly 1 to thereby electrically connect the other connector and the cable 20. The connector 10 is provided with a plurality of contact terminals 11 (see FIGS. 2 and 3) which serves as electrical contact points with the other connector. Although nineteen contact terminals 11 are provided in the connector 10 of the present embodiment, the number of contact terminals 11 is not particularly limited. The number of contact terminals 11 can be appropriately set in accordance with the number of terminals of the other connector. In FIG. 3, only five contact terminals 11 of the nineteen contact terminals are illustrated, and the remaining fourteen contact terminals 11 are not illustrated.

The cable 20 includes a cable unit 21 in which two insulating wires 22 are covered together by a cable shielding layer 23 as illustrated in FIG. 2. Within the cable unit 21, the insulating wires 22 are electromagnetically shielded from the outside by the cable shielding layer 23. In the drawing, one insulating wire 22 of the two insulating wires 22 is not illustrated. The insulating wire 22 has a configuration in which a conductor 221 transmitting electrical signals is covered by a cable insulating layer 222 as illustrated in the drawing.

Although not particularly illustrated, a drain line for electrically connecting the cable shielding layer 23 and the ground (GND) is provided in the cable unit 21.

The cable 20 of the present embodiment includes four such cable units 21 in total. Moreover, the cable 20 includes seven insulating wires in addition to the four cable units 21. Thus, nineteen insulating wires 22 and drain lines in total are provided in the cable 20, and these nineteen insulating wires 22 and drain lines are electrically connected to nineteen contact terminals 11 of the connector 10 via the wiring board 30.

Here, as illustrated in FIG. 2, the insulating wire 22 is covered by the cable shielding layer 23 in a cable body portion 20*a* of the cable 20. In a cable exposed portion 20*b* positioned at the end portion of the cable body portion 20*a*, the insulating wire 22 is exposed from the cable shielding layer 23, and the conductor 221 is exposed from the insulating wire 22. Moreover, in the cable exposed portion 20*b*, the conductor 221 is connected by soldering to a second connecting portion 33 described later, of the wiring board 30. As above, the impedance of the cable exposed portion 20*b* exposed from the cable shielding layer 23 is likely to be affected by the external environment.

As illustrated in FIGS. 2 and 3, the wiring board 30 includes an insulating substrate 31, first connecting portions 32, second connecting portions 33, and wiring lines 34.

As illustrated in FIGS. 2 and 3, the insulating substrate 31 is a substrate composed of a glass epoxy-based resin, for example, and is disposed between the connector 10 and the cable 20.

The first connecting portions 32 are configured to electrically connect the contact terminals 11 of the connector 10 and the wiring lines 34. As illustrated in FIG. 2, the first connecting portions 32 are connected by soldering to the contact terminals 11 by solders 32*a* in a state where the first connecting portions 32 are exposed from the insulating substrate 31. In the present embodiment, since the first connecting portions 32 are exposed from the insulating substrate 31, the impedance of the first connecting portions 32 is likely to be affected by the external environment.

Here, nineteen first connecting portions 32 are provided on the wiring board 30 so as to correspond to the nineteen contact terminals 11 of the connector 10. In the present embodiment, as illustrated in FIG. 3, nine first connecting portions 32 are disposed on one main surface 31*a* of the insulating substrate 31 (five of the nine first connecting portions 32 are not illustrated). Ten first connecting portions (not illustrated) are disposed on the another main surface of the insulating substrate 31. The number of first connecting portions 32 is not limited to 19, and the number can be appropriately set in accordance with the number of contact terminals 11.

Moreover, these first connecting portions 32 are arranged at a relatively small first pitch $P_1$ in the plan view illustrated in FIG. 3.

The second connecting portions 33 are configured to electrically connect the conductors 221 of the cable 20 and the wiring lines 34. As illustrated in FIG. 2, the second connecting portions 33 are connected by soldering to the conductors 221 by solders 33*a* in a state where the second connecting portions 33 are exposed from the insulating substrate 31. Since the second connecting portions 33 are exposed from the insulating substrate 31, the impedance of the second connecting portions 33 is likely to be affected by the external environment.

Here, nineteen second connecting portions 33 are provided on the wiring board 30 so as to correspond to the nineteen insulating wires 22 and drain lines of the cable 20. In the present embodiment, as illustrated in FIG. 3, nine second connecting portions 33 are disposed on one main surface 31*a* of the insulating substrate 31 (five of the nine second connecting portions 33 are not illustrated). Ten second connecting portions (not illustrated) are disposed on the another main surface of the insulating substrate 31. The number of second connecting portions 33 is not limited to 19, and the number can be appropriately set in accordance with the number of insulating wires 22 or drain lines of the cable 20.

Moreover, these second connecting portions 33 are arranged at a second pitch $P_2$ in the plan view illustrated in FIG. 3. As illustrated in the drawing, the second pitch $P_2$ of the second connecting portions 33 is relatively larger than the first pitch $P_1$ of the first connecting portions 32 ($P_1<P_2$). As above, by arranging the second connecting portions 33 at the relatively large second pitch $P_2$, it is possible to suppress the short-circuiting of the conductors 221 when connecting the conductors 221 and the second connecting portions 33.

As illustrated in FIGS. 2 and 3, the wiring lines 34 are configured to electrically connect the first connecting portions 32 and the second connecting portions 33. In the wiring board 30 of the present embodiment, nineteen wiring lines 34 are provided so as to correspond to the nineteen first connecting portions 32 and the nineteen second connecting portions 33. The number of wiring lines 34 is not limited to 19, and the number can be appropriately set in accordance with the number of first connecting portions 32 and second connecting portions 33.

As illustrated in FIG. 2, the wiring lines 34 are embedded in the insulating substrate 31. One end of the wiring line 34 is exposed from the insulating substrate 31 and connected to the lower portion of the first connecting portion 32, and the another end thereof is exposed from the insulating substrate 31 and connected to the lower portion of the second connecting portion 33.

As above, in the present embodiment, since the wiring lines 34 are embedded in the insulating substrate 31, the impedance of the wiring lines 34 is unlikely to be affected by the external environment.

Moreover, in the present embodiment, the pitch of the wiring lines 34 changes continuously between the first pitch $P_1$ of the first connecting portions 32 and the second pitch $P_2$ of the second connecting portions 33 as in the plan view illustrated in FIG. 3. That is, these wiring lines 34 electrically connect the first connecting portions 32 and the second connecting portions 33 while switching the pitch thereof between the first pitch $P_1$ of the first connecting portions 32 and the second pitch $P_2$ of the second connecting portions 33.

As illustrated in FIG. 2, the insulating material 40 surrounds the end portion of the cable 20 and the wiring board 30 to protect the end portion of the cable 20 and the wiring board 30.

The insulating material 40 includes a first portion A configured to surround the first connecting portions 32 of the wiring board 30 and a second portion B configured to surround the wiring lines 34 and the cable exposed portion 20*b*. The second portion B of the insulating material 40 may be configured to surround at least the second connecting portions 33 of the wiring board 30 and the cable exposed portion 20*b*.

As illustrated in FIG. 2, the first portion A of the insulating material 40 comprises a foam 41 and a hot melt 42. On the other hand, as illustrated in the drawing, the second portion B of the insulating material 40 comprises only the hot melt 42.

As illustrated in the drawing, the foam 41 is stacked on the first connecting portions 32. An expanded polypropylene (PP) tape may be used as the foam 41. The foam 41 may be one obtained by expanding polyethylene (PE), polytetrafluorotthylene (PTFE), polyethylene terephthalate (PET), acrylic resin, polyvinyl chloride (PVC), or the like.

Since the foam 41 contains air therein, the foam has a smaller dielectric constant (a dielectric constant close to that of air) than a hot melt 42 (described later). Specifically, the dielectric constant ($\epsilon_{eff}$) of the foam 41 is preferably smaller than 3 ($\epsilon_{eff}<3$), or the dielectric tangent tanδ of the foam 41 is preferably smaller than 0.01 ($\tan\delta<0.01$).

In the present embodiment, although the foam 41 is stacked on the solders 32*a* that connect the first connecting portions 32 and the contact terminals 11, the present invention is not particularly limited to this. For example, the foam 41 may be stacked on portion of the connector shielding layer 50 facing the first connecting portions 32, and the hot melt 42 may be interposed between the foam 41 and the first connecting portions 32.

The hot melt 42 is configured to surround the wiring board 30 and the cable exposed portion 20*b* so as to fix the wiring board 30 and the cable 20. As described above, since the foam 41 is stacked on the first connecting portions 32, the hot melt 42 in the first portion A surrounds the wiring board 30 (the first connecting portions 32) via the foam 41. On the other hand, the hot melt 42 in the second portion B directly surrounds the wiring board 30 and the cable exposed portion 20*b*. The hot melt 42 may be one which has excellent heat resistance and mechanical strength, and the hot melt 42 may be composed of polyamide, polyethylene, polypropylene, or the like, for example. Instead of the hot melt 42, another insulating material may be used so as to surround the wiring board 30 and the cable exposed portion 20*b*.

As described above, in the present embodiment, since the foam 41 (air) is contained in only the first portion A of the insulating material 40, a first dielectric constant $E_1$ of the first portion A of the insulating material 40 is relatively smaller than a second dielectric constant $E_2$ of the second portion B of the insulating material 40 (the first dielectric constant is close to the dielectric constant of the air).

In such an insulating material 40, the wiring board 30 and the cable exposed portion 20*b* are surrounded (disposed) by the following method. First, the tape-shaped foam 41 is disposed in the first connecting portions 32. Subsequently, the wiring board 30 and the cable exposed portion 20*b* are set on a die (not illustrated in particular), and the molten hot melt 42 is flowed therein. Subsequently, the hot melt 42 is cooled and solidified, whereby the insulating material 40 is disposed.

In the present embodiment, although the foam 41 (air) is contained in the first portion A of the insulating material 40 so that the first dielectric constant $E_1$ of the first portion A is smaller than the second dielectric constant $E_2$ of the second portion B, the present invention is not particularly limited to this. For example, as illustrated in FIG. 4, the first portion A of the insulating material 40 may comprise a first hot melt 42*a*, and the second portion B of the insulating material 40 may comprise a second hot melt 42*b*. In this case, the dielectric constant of the first hot melt 42*a* is different from the dielectric constant of the second hot melt 42*b*. For example, the dielectric constant of the first hot melt 42*a* is made relatively smaller than the dielectric constant of the second hot melt 42*b* so that the first dielectric constant $E_1$ of the first portion A is smaller than the second dielectric constant $E_2$ of the second portion B.

Returning to FIG. 2, the connector shielding layer 50 surrounds the insulating material 40, and the wiring board 30 and the cable exposed portion 20*b* are electromagnetically shielded from the outside via the insulating material 40. Although not illustrated in particular, one end of the connector shielding layer 50 is soldered to the metal shell of the connector 10 and is electrically connected to the ground (GND) via the metal shell.

Such a connector shielding layer 50 is formed of tape-shaped copper (Cu), for example. The material of the connector shielding layer 50 is not particularly limited as long as it has conductive properties.

As illustrated in FIG. 2, the insulating cover layer 60 is configured to surround the connector shielding layer 50 and protect the connector shielding layer 50, the wiring board 30, and the cable exposed portion 20*b*. The insulating cover layer 60 is composed of a polypropylene-based resin or an olefin-based resin, for example.

Next, the effect of the present embodiment will be described.

In the present embodiment, the contact terminals 11 and the conductors 221 are connected via the wiring board 30 so that the pitch (first pitch $P_1$) of the contact terminals 11 is made relatively smaller than the pitch (second pitch $P_2$) of the conductors 221. Thus, it is possible to decrease the size of the connector 10.

Moreover, in the present embodiment, matching between the impedance of the first connecting portions 32, the impedance of the second connecting portions 33, and the impedance of the cable exposed portion 20*b* is promoted so that the transmission characteristics of the connector assembly 1 are improved.

Specifically, as illustrated in FIG. 2, the first portion A of the insulating material 40 comprises the foam 41 and the hot melt 42, and the second portion B of the insulating material 40 comprises the hot melt 42 so that the first dielectric constant $E_1$ is made relatively smaller than the second dielectric constant $E_2$ ($E_1<E_2$). In this way, the decrease of the impedance of the first connecting portions 32 is suppressed, and the matching between the impedance of the first connecting portions 32, the impedance of the second connecting portions 33, and the impedance of the cable exposed portion 20*b* is promoted.

Furthermore, the second portion B may be configured to include: a third portion C that surrounds the wiring lines 34 and the second connecting portions 33; and a fourth portion D that is adjacent to the third portion C so as to surround a portion of the cable exposed portion 20*b*. The third portion C of the insulating material 40 and the fourth portion D of the insulating material 40 may be composed of materials having different dielectric constants. The third portion C of the insulating material 40 may be a portion which is configured to surround at least the second connecting portions 33 of the wiring board 30. Moreover, "a portion of the cable exposed portion 20*b*" as mentioned herein is a portion of the cable exposed portion 20*b* which is not in contact with the second connecting portions 33.

For example, as illustrated in FIG. 5, the first portion A of the insulating material 40 may comprise the foam 41 and the first hot melt 42*a*. The third portion C of the insulating material 40 may comprise only the first hot melt 42*a*. The fourth portion D of the insulating material 40 may comprise the second hot melt 42*b* having a dielectric constant different from that of the first hot melt 42*a*. In this way, since the matching between the impedance of three portions of the first connecting portions 32, the second connecting portions 33, and the cable exposed portion 20*b* can be promoted, it is possible to further improve the transmission characteristics of the connector assembly 1.

In the present embodiment, although the insulating material 40 is configured so that the first dielectric constant $E_1$ is relatively smaller than the second dielectric constant $E_2$, the present invention is not particularly limited to this. For example, if the pitch $P_1$ of the first connecting portions 32 decreases, since the impedance relation may be reversed, the insulating material may be configured so that the first dielectric constant $E_1$ is relatively larger than the second dielectric constant $E_2$ depending on the structure of the first connecting portions 32, the second connecting portions 33 and the cable exposed portion 20*b* etc. and the impedance matching in the connector assembly is promoted.

<<Second Embodiment>>

Next, a second embodiment will be described.

Figure 6:
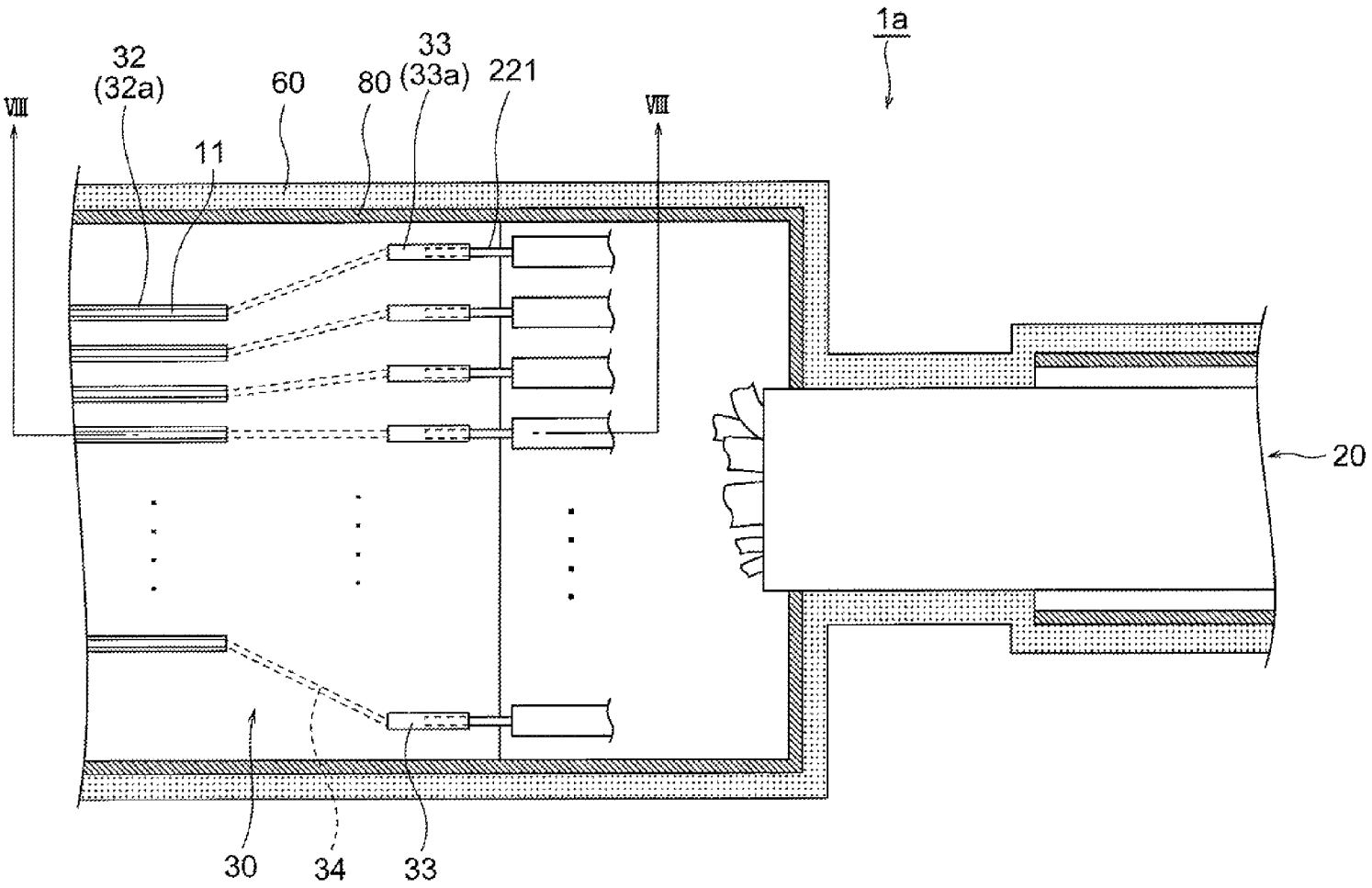
FIG. 6 is a cross-sectional view of a connector assembly in a second embodiment of the present invention.
Figure 7:
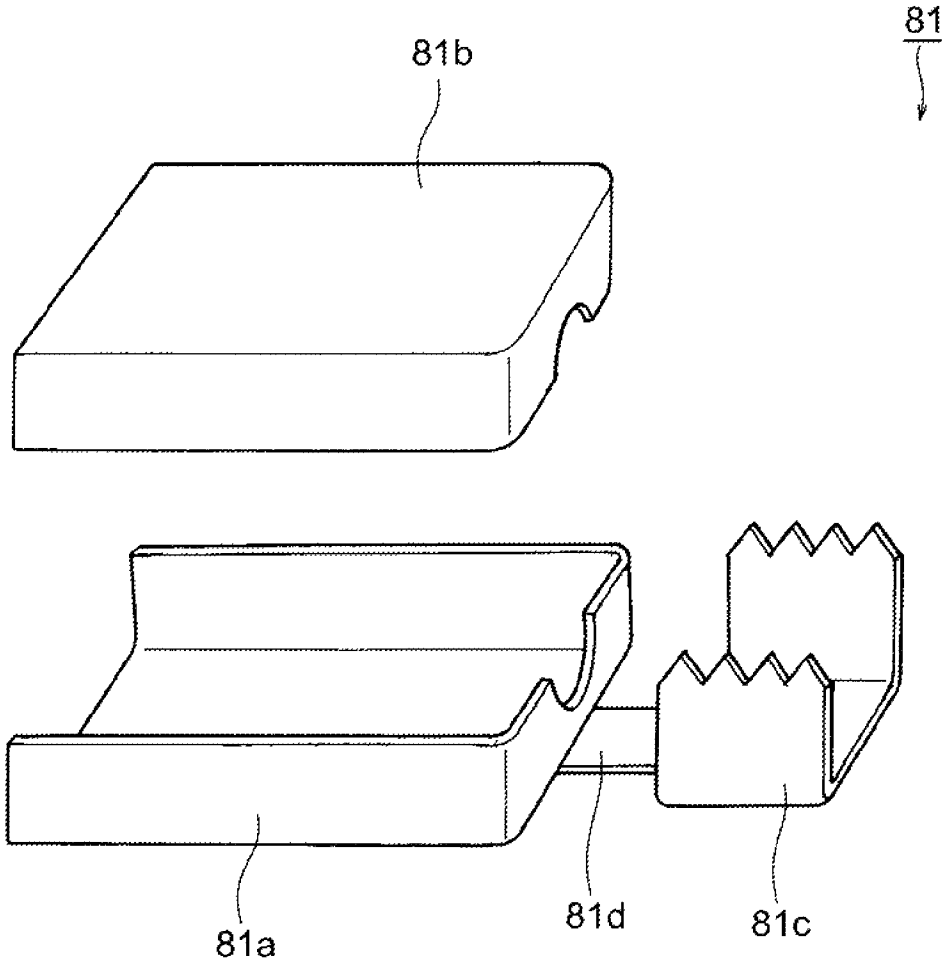
FIG. 7 is a perspective view illustrating a connector shielding layer of the connector assembly in the second embodiment of the present invention.
Figure 8:
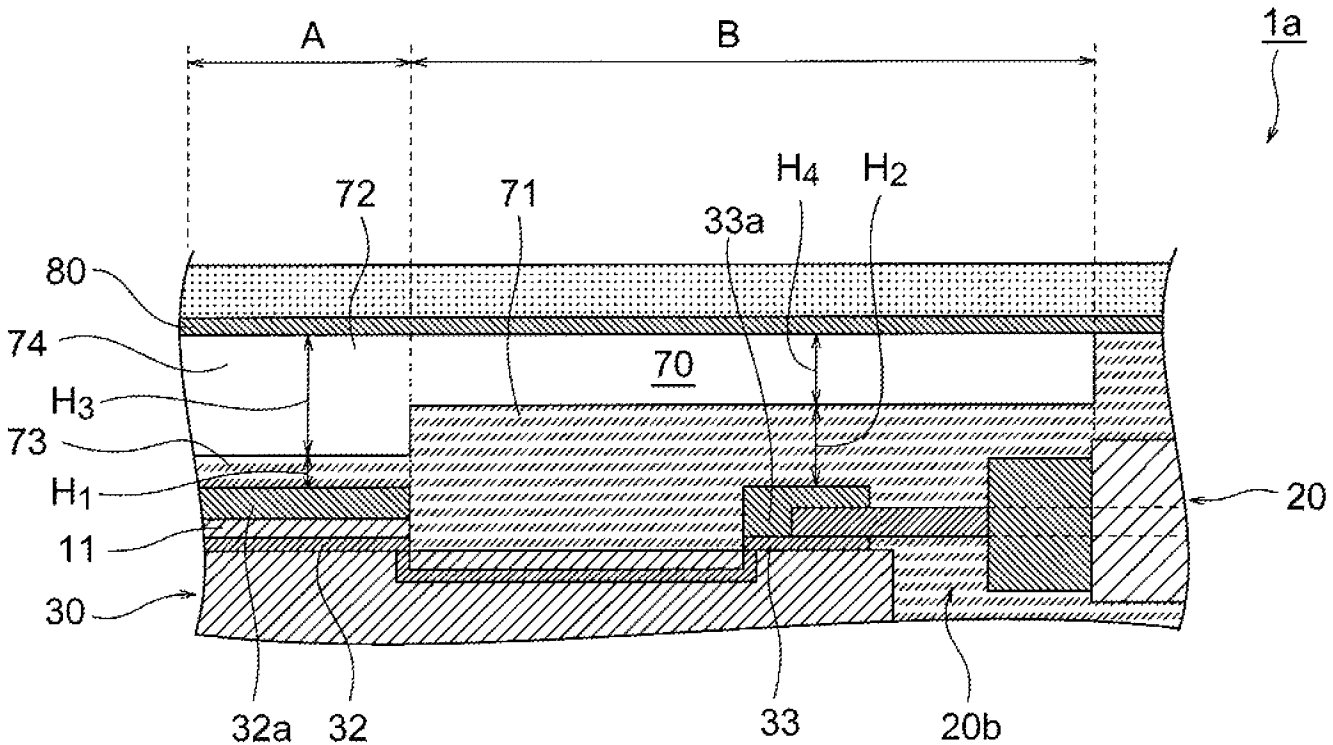
FIG. 8 is a cross-sectional view along the line VIII-VIII of FIG. 6.
Figure 9:
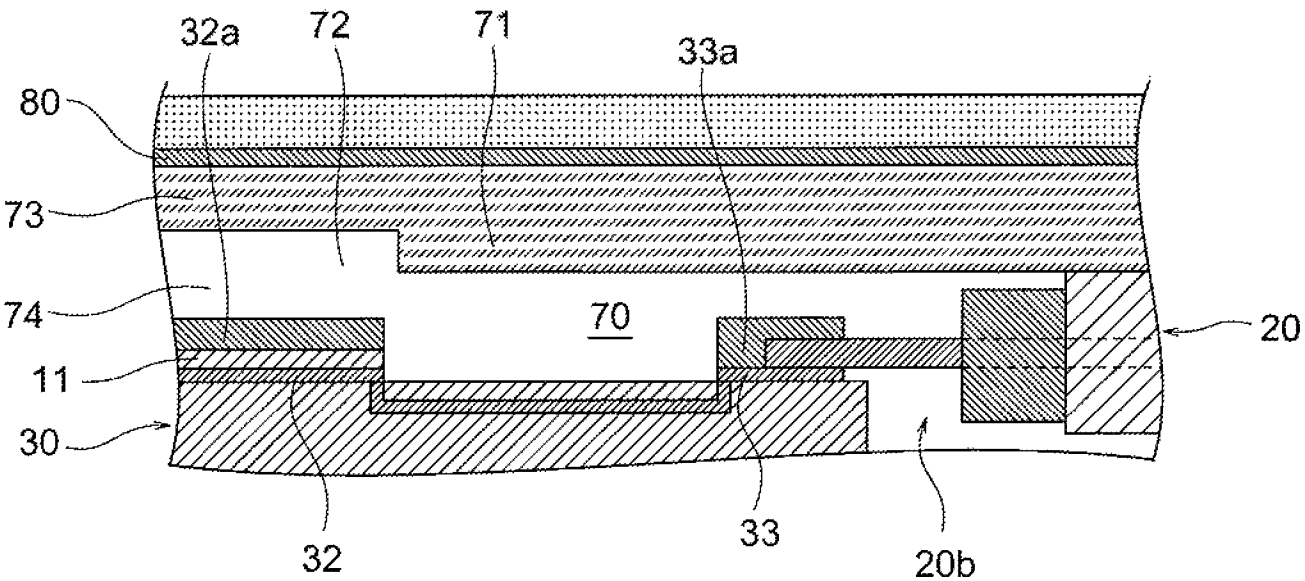
FIG. 9 is a cross-sectional view illustrating a first modification example of the connector assembly in the second embodiment of the present invention.
Figure 10:
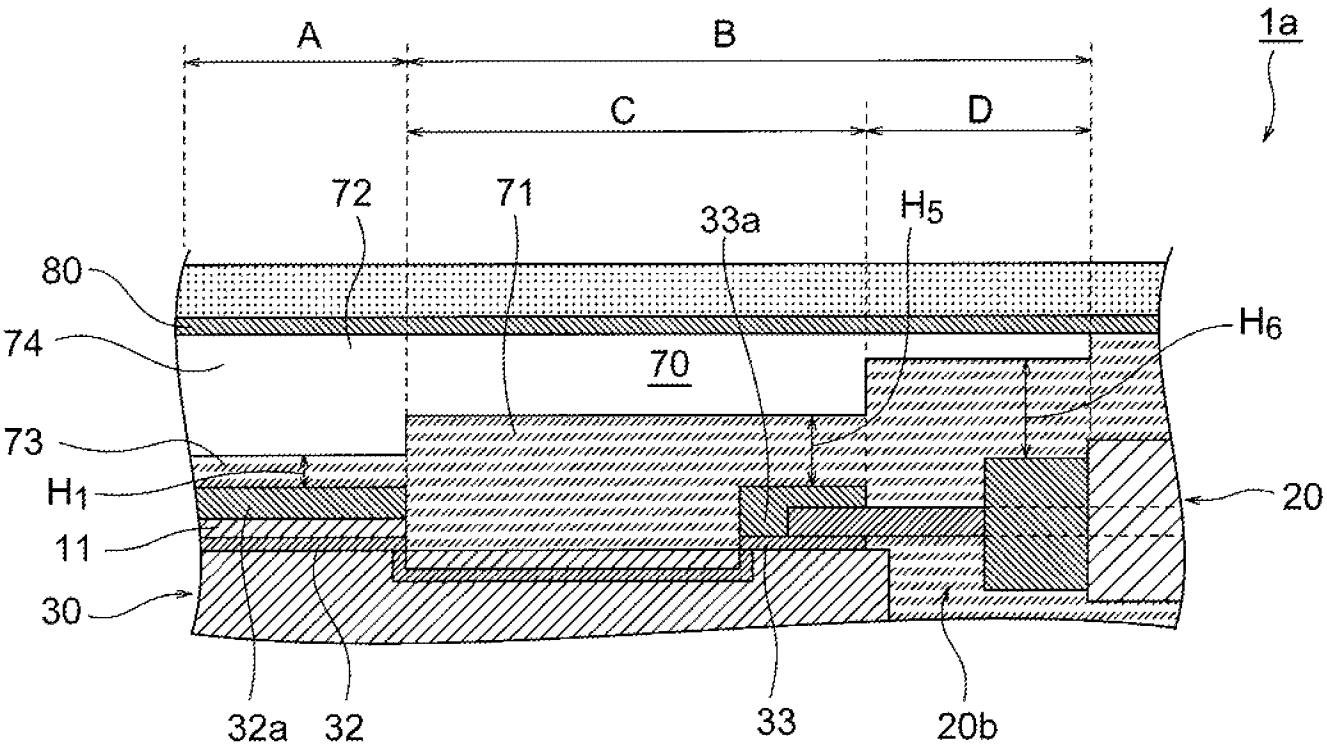
FIG. 10 is a cross-sectional view illustrating a second modification example of the connector assembly in the second embodiment of the present invention.

FIG. 6 is a cross-sectional view of a connector assembly in the present embodiment, FIG. 7 is a perspective view illustrating a connector shielding layer of the connector assembly in the present embodiment, FIG. 8 is a cross-sectional view along the line VIII-VIII line of FIG. 6, and FIG. 9 and FIG. 10 are cross-sectional views illustrating modification examples of the connector assembly in the present embodiment.

A connector assembly 1 a of the present embodiment is different from that of the first embodiment in terms of the configuration of an insulating material 70 and the configuration of a connector shielding layer 80, and the other configurations are the same as those of the first embodiment. In the following description, only the differences from the first embodiment will be described, and the same configurations as those of the first embodiment will be denoted by the same reference numerals, and description thereof will not be provided.

As illustrated in FIG. 7, the connector shielding layer 80 of the present embodiment comprises a metal shell 81.

The metal shell 81 includes: shell body portions 81*a* and 81*b* in which the wiring board 30 and the cable exposed portion 20*b* are accommodated; a shell fixing portion 81*c* that is bent inward so as to fix the cable 20; and a shell connecting portion 81*d* that connects the shell body portion 81*a* and the shell fixing portion 81*c*. The metal shell 81 is formed by bending a plate composed of stainless, for example.

In the present embodiment, since the connector shielding layer 80 comprises the metal shell 81, it is possible to fix the cable 20 without via the insulating material 70 as described above. Moreover, it is possible to fix the connector 10 and the wiring board 30 by connecting the shell body portions 81*a* and 81*b* to the connector 10. In this way, even when a gaseous insulating material 72 described later is contained in the insulating material 70, the wiring board 30 and the cable 20 are fixed inside the connector assembly 1*a*.

As illustrated in FIG. 8, the insulating material 70 of the present embodiment includes a solid insulating material 71 and a gaseous insulating material 72.

The solid insulating material 71 is formed of a hot melt made from polyamide, polyethylene, polypropylene, or the like, for example, and forms a solid insulating layer 73.

As illustrated in the drawing, the solid insulating layer 73 directly surrounds the wiring board 30 and the cable exposed portion 20*b*. In the present embodiment, a first thickness $H_1$ of the solid insulating layer 73 in the first portion A is relatively smaller than a second thickness $H_2$ of the solid insulating layer 73 in the second portion B ($H_1<H_2$).

The gaseous insulating material 72 is formed of air, for example, and is interposed between the solid insulating material 71 and the connector shielding layer 80 to form a gaseous insulating layer 74. Moreover, the gaseous insulating material 72 is not particularly limited to air as long as it is formed of gas.

The thickness relation of the gaseous insulating layer 74 is reverse to that of the solid insulating layer 73, and a third thickness $H_3$ of the first portion A is relatively larger than a fourth thickness $H_4$ of the second portion B.

As above, in the present embodiment, the first portion A of the insulating material 70 contains a larger amount of air (gas) than the second portion B of the insulating material 70, and the first dielectric constant $E_1$ of the first portion A is relatively smaller than the second dielectric constant $E_2$ of the second portion B ($E_1<E_2$). Thus, the decrease of the impedance of the first connecting portions 32 is suppressed, and the matching between the impedance of the first connecting portions 32, the impedance of the second connecting portions 33, and the impedance of the cable exposed portion 20*b* is promoted. In this way, it is possible to improve the transmission characteristics of the connector assembly 1*a*.

In the present embodiment, although the gaseous insulating material 72 is interposed between the solid insulating material 71 and the connector shielding layer 80, the gaseous insulating material 72 may be interposed between the wiring board 30 and the solid insulating material 71 and may be interposed between the cable exposed portion 20*b* and the solid insulating material 71, as illustrated in FIG. 9.

Moreover, in the present embodiment, although the first thickness $H_1$ is relatively smaller than the second thickness $H_2$, the present invention is not particularly limited to this, and the solid insulating layer 73 may be formed so that the first thickness $H_1$ is larger than the second thickness $H_2$.

Moreover, as illustrated in FIG. 10, the second portion B of the insulating material 70 may be configured to include: a third portion C that surrounds the wiring lines 34 and the second connecting portions 33; and a fourth portion D that is adjacent to the third portion C so as to surround the cable exposed portion 20*b*. A fifth thickness $H_5$ of the third portion C of the solid insulating layer 73 may be different from a sixth thickness $H_6$ of the fourth portion D of the solid insulating layer 73. For example, the solid insulating layer 73 may be formed so that the fifth thickness $H_5$ is smaller than the sixth thickness $H_6$ ($H_5<H_6$). The third portion C may be a portion which is configured to surround at least the second connecting portions 33 of the wiring board 30. Moreover, "a portion of the cable exposed portion 20*b*" as mentioned herein is a portion of the cable exposed portion 20*b* which is not in contact with the second connecting portions 33.

As above, in the solid insulating layer 73, the first thickness $H_1$ of the first portion A, the fifth thickness $H_5$ of the third portion C, and the sixth thickness $H_6$ of the fourth portion D may be made different from each other so that the matching between the impedance of three portions of the first connecting portions 32, the second connecting portions 33, and the cable exposed portion 20*b* is promoted. In this way, it is possible to further improve the transmission characteristics of the connector assembly 1*a*.

<<Third Embodiment>>

Next, a third embodiment will be described.

Figure 11:
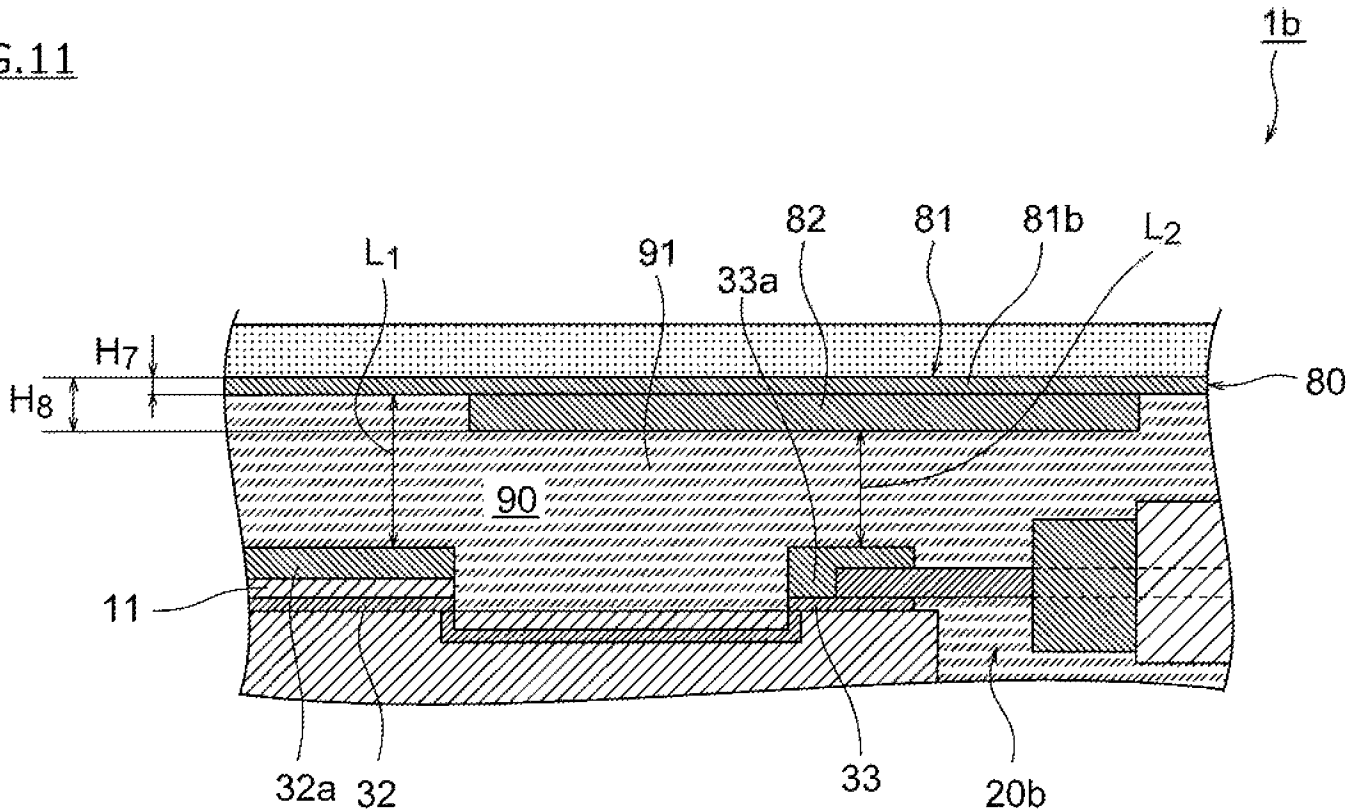
FIG. 11 is a cross-sectional view of a connector assembly in a third embodiment of the present invention.
Figure 12:
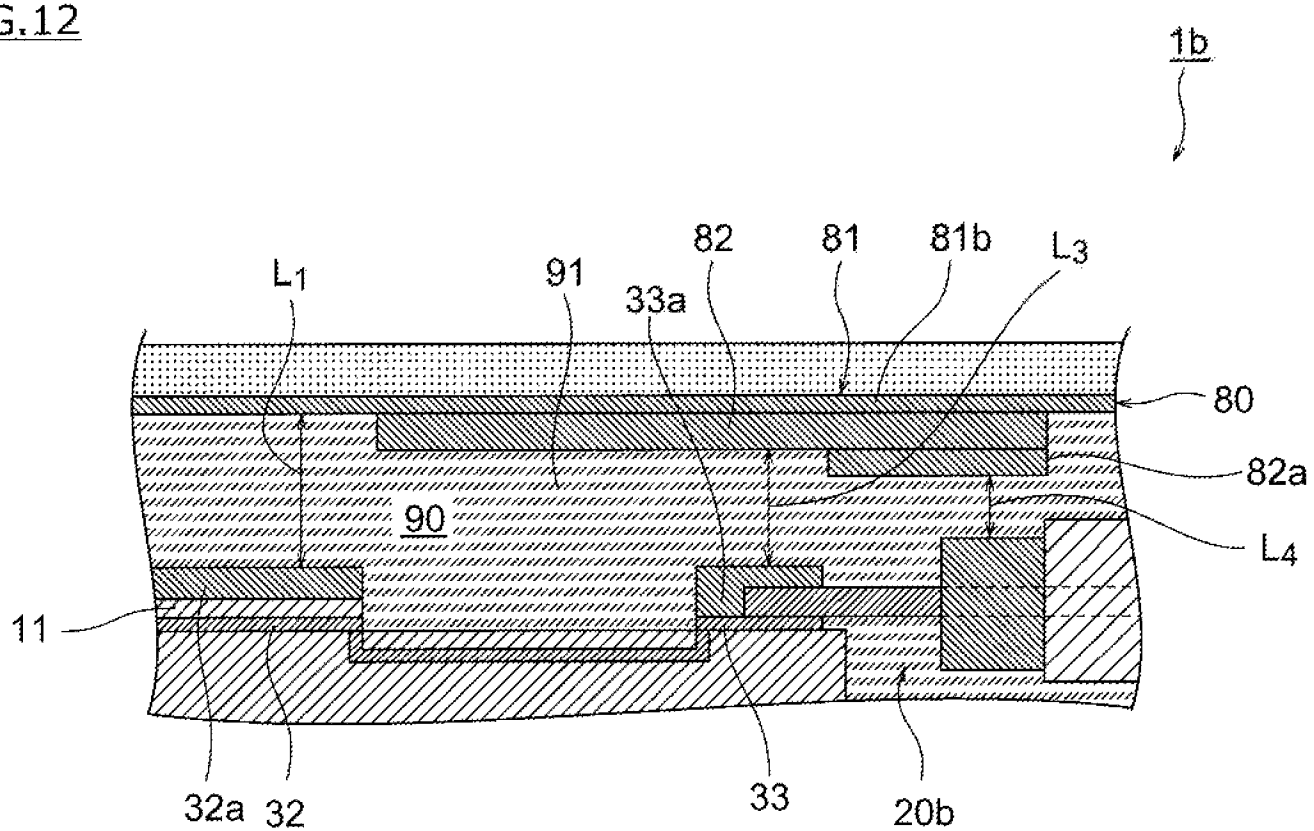
FIG. 12 is a cross-sectional view illustrating a modification example of the connector assembly in the third embodiment of the present invention.

FIG. 11 is a cross-sectional view of a connector assembly in the present embodiment, and FIG. 12 is a cross-sectional view illustrating a modification example of the connector assembly in the present embodiment.

A connector assembly 1*b* of the present embodiment is different from that of the first embodiment in terms of the configuration of an insulating material 90 and the configuration of a connector shielding layer 80, and the other configurations are the same as those of the first embodiment. In the following description, only the differences from the first embodiment will be described, and the same configurations as those of the first embodiment will be denoted by the same reference numerals, and description thereof will not be provided.

The insulating material 90 of the present embodiment comprises only one kind of hot melt 91.

The connector shielding layer 80 comprises the metal shell 81 similarly to the second embodiment. In the present embodiment, in the shell body portion 81*b* in which the wiring board 30 and the cable exposed portion 20*b* are accommodated, a shield plate 82 is stacked in a portion (inner surface) corresponding to the second connecting portions 33 of the wiring board 30 and the cable exposed portion 20*b*. The shield plate 82 is formed of tape-shaped copper, for example.

In the connector assembly 1*b* of the present embodiment, an eighth thickness $H_8$ of a portion of the connector shielding layer 80 corresponding to the second connecting portions 33 and the cable exposed portion 20*b* is relatively larger than a seventh thickness $H_7$ of a portion of the connector shielding layer 80 corresponding to the first connecting portions 32 ($H_7<H_8$).

That is, in the connector assembly 1*b* of the present embodiment, the distance $L_1$ from the connector shielding layer 80 to the first connecting portions 32 is relatively smaller than the distance $L_2$ from the connector shielding layer 80 to the second connecting portions 33 and the cable exposed portion 20*b* ($L_1>L_2$). The impedance of the second connecting portions 33 and the impedance of the cable exposed portion 20*b* are decreased. In this way, it is possible to promote the matching between the impedance of the first connecting portions 32, the impedance of the second connecting portions 33, and the impedance of the cable exposed portion 20*b* and to improve the transmission characteristics of the connector assembly 1*b*.

In the present embodiment, although the shield plate 82 is stacked on the metal shell 81, the present invention is not particularly limited to this. For example, the metal shell 81 may be formed integrally so that the eighth thickness $H_8$ of the portion of the connector shielding layer 80 corresponding to the second connecting portions 33 and the cable exposed portion 20*b* is relatively larger than the seventh thickness $H_7$ of the portion of the connector shielding layer 80 corresponding to the first connecting portions 32.

Alternatively, the metal shell 81 may be formed so that the portion of the connector shielding layer 80 corresponding to the second connecting portions 33 and the cable exposed portion 20*b* protrude inward in a convex shape more than the portion of the connector shielding layer 80 corresponding to the first connecting portions 32.

Moreover, in the present embodiment, although the eighth thickness $H_8$ is relatively larger than the seventh thickness $H_7$, the present invention is not particularly limited to this. The eighth thickness $H_8$ may be made relatively smaller than the seventh thickness $H_7$, and the distance $L_2$ from the connector shielding layer 80 to the second connecting portions 33 and the cable exposed portion 20*b* may be made relatively larger than the distance $L_1$ from the connector shielding layer 80 to the first connecting portions 32.

Moreover, the connector shielding layer 80 may be configured so that a distance $L_3$ from the connector shielding layer 80 to the second connecting portions 33 is different from a distance $L_4$ from the connector shielding layer 80 to the cable exposed portion 20*b*. For example, as illustrated in FIG. 12, a shield plate 82*a* may be further stacked on a portion (inner surface) of the shell body portion 81*b* corresponding to the cable exposed portion 20*b*, and the distance $L_4$ from the connector shielding layer 80 to the cable exposed portion 20*b* may be made relatively smaller than the distance $L_3$ from the connector shielding layer 80 to the second connecting portions 33 ($L_3>L_4$).

As above, the distance $L_1$ from the connector shielding layer 80 to the first connecting portions 32, the distance $L_3$ from the connector shielding layer 80 to the second connecting portions 32, and the distance $L_4$ from the connector shielding layer 80 to the cable exposed portion 20*b* may be made different from each other so that the matching between the impedance of three portions of the first connecting portions 32, the second connecting portions 33, and the cable exposed portion 20*b* can be promoted. In this way, it is possible to further improve the transmission characteristics of the connector assembly 1*b*.

The embodiments described herein above are presented in order to facilitate understanding of the present invention and are not presented to limit the present invention. Thus, the respective elements disclosed in the above embodiments are intended to cover all design alterations belonging to the technical scope of the present invention and equivalents thereof.

Moreover, in the connector assembly 1*b* according to the third embodiment, foam may be stacked on the first connecting portions 32 similarly to the first embodiment. In this way, the impedance matching of the connector assembly 1*b* can be further improved.

EXAMPLES

The advantageous effects of the present invention were verified through examples which further substantiate the present invention and comparative examples thereof. The following examples and comparative examples are presented in order to verify the advantageous effects of improving the transmission characteristics of the connector assembly of the embodiments described above.

Figure 13:
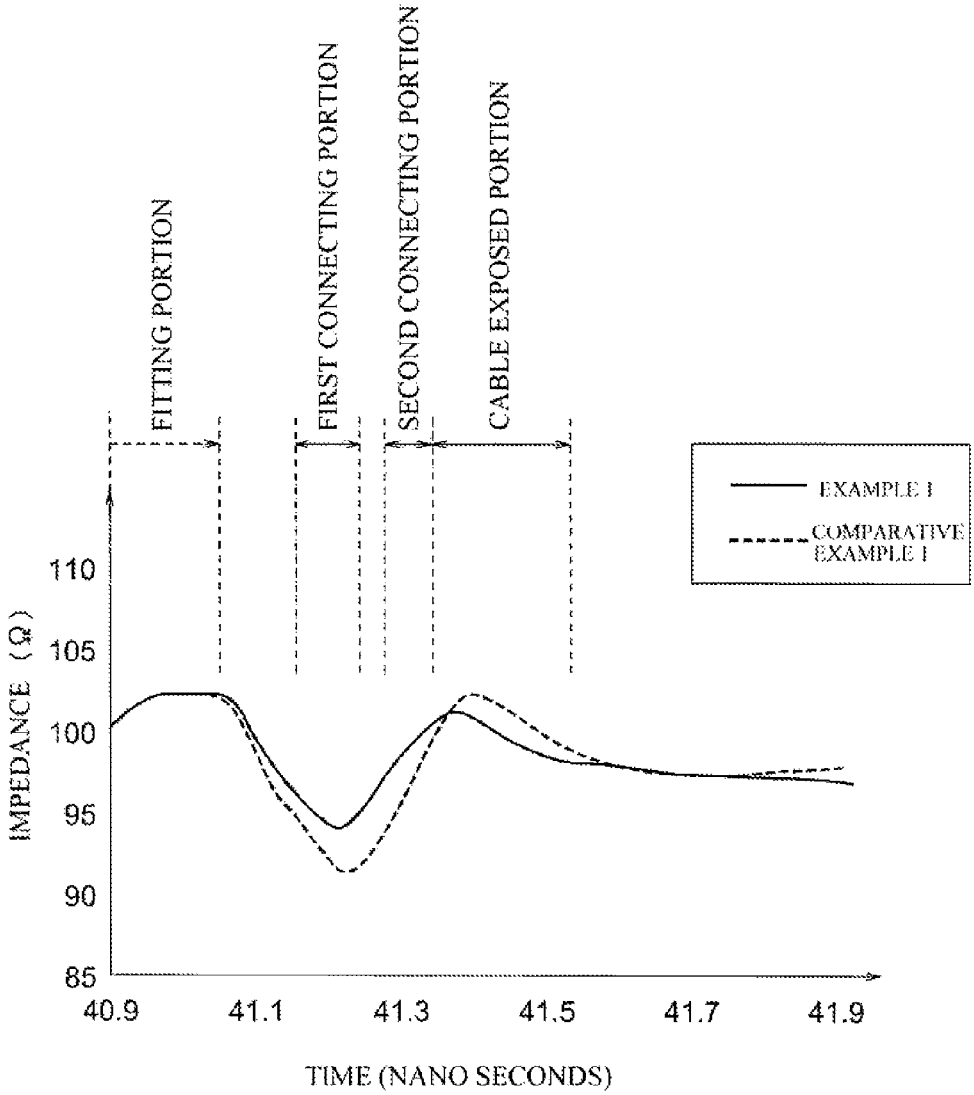
FIG. 13 is a graph illustrating the impedance of Example and Comparative Example for comparison.

FIG. 13 is a graph illustrating the impedance of Example and Comparative Example for comparison.

Example 1

In Example 1, a sample having the same structure as the first embodiment described above was prepared. In this sample, a polypropylene tape expanded to have a dielectric constant of about 2.0 was used as foam, polyamide having a dielectric constant of 3.3 to 3.6 was used as a hot melt, and a copper tape was used as a connector shielding layer.

The impedance from the connector to the cable was measured for the sample of Example. For the impedance measurement, a sampling oscilloscope (TDS8000, product of Japan Tektronix INC.) was used. The measurement results of Example are illustrated in FIG. 13. The vertical axis of FIG. 13 represents impedance (Ω). Moreover, the horizontal axis of FIG. 13 represents signal transmission time (nano seconds) which signifies a portion of the connector assembly. 41.0 nano seconds signifies the connector, about 41.2 nano seconds signifies the first connecting portion, and 41.4 to 41.5 nano seconds signifies a portion between the second connecting portion and the cable exposed portion.

Comparative Example 1

In Comparative Example 1, a sample having the same structure as Example 1 was prepared except that the insulating material comprises only a hot melt. The impedance was measured for the sample of Comparative Example by the same method as Example 1. The measurement results of Comparative Example are illustrated in FIG. 13.

<Discussion>

In Comparative Example 1, as illustrated in FIG. 13, the impedance is extremely low in the first connecting portion. This is considered to be attributable to the fact that only the hot melt having a larger dielectric constant than air is stacked on the first connecting portion.

On the other hand, in Example 1, as illustrated in FIG. 13, the decrease of the impedance in the first connecting portion is suppressed as compared to Comparative Example 1. This is considered to be attributable to the fact that since the foam and the hot melt surrounded the first connecting portion in Example 1, the first dielectric constant $E_1$ in the first portion of the insulating material decreases, and the decrease of the impedance in the first connecting portion is suppressed.

As above, it can be understood that since the first portion of the insulating material comprises the foam and the hot melt, and the second portion of the insulating material comprises the hot melt so that the first dielectric constant $E_1$ is made relatively smaller than the second dielectric constant $E_2$, the matching between the impedance of the first connecting portion, and the second connecting portion and the cable exposed portion is promoted.

EXPLANATIONS OF LETTERS OR NUMERALS

1, 1*a*, 1*b*: connector assembly
10: connector
20: cable
22: insulating wire
221: conductor
222: cable insulating layer
30: wiring board
32: first connecting portion
33: second connecting portion
34: wiring line
40, 70, 90: insulating material
41: foam
42: hot melt
50, 80: connector shielding layer
81: metal shell
82: shield plate
60: insulating cover layer

The invention claimed is:

1. A connector assembly comprising:

a connector including contact terminals;

a cable including conductors; and a wiring board including:

first connecting portions which are arranged at a first pitch and to which the contact terminals are electrically connected;

second connecting portions which are arranged at a second pitch and to which the conductors of the cable are electrically connected; and wiring lines which electrically connect the first connecting portions and the second connecting portions, the first pitch is smaller than the second pitch, wherein the cable includes a cable exposed portion in which insulating wires including the conductors are exposed from a cable shielding layer and the conductors are exposed from the insulating wires, the connector assembly further comprises:

a connector shielding layer which is provided around the wiring board and the cable exposed portion; and an insulating material which is interposed between the connector shielding layer and the wiring board and which is interposed between the connector shielding layer and the cable exposed portion, a dielectric constant of a first portion of the insulating material is different from a dielectric constant of a second portion of the insulating material, the first portion surrounds the first connecting portions in the insulating material, and the second portion surrounds the second connecting portions and the cable exposed portion in the insulating material.

2. The connector assembly according to claim 1, wherein the first portion of the insulating material comprises a hot melt and a foam, and the second portion of the insulating material comprises the hot melt.

3. The connector assembly according to claim 1, wherein the first portion of the insulating material comprises a first hot melt, and the second portion of the insulating material comprises a second hot melt which has a dielectric constant different from that of the first hot melt.

4. The connector assembly according to claim 1, wherein the second portion includes:

a third portion which surrounds the second connecting portions; and a fourth portion which is adjacent to the third portion and which surrounds the cable exposed portion, and a dielectric constant of the third portion of the insulating material is different from a dielectric constant of the fourth portion of the insulating material.

5. The connector assembly according to claim 1, wherein the insulating material includes a solid insulating material and a gaseous insulating material, the gaseous insulating material is interposed between the solid insulating material and the connector shielding layer, or the gaseous insulating material is interposed between the solid insulating material and the wiring board and is interposed between the solid insulating material and the cable exposed portion, and a thickness of the first portion of the solid insulating material is different from a thickness of the second portion of the solid insulating material.

6. The connector assembly according to claim 5, wherein the second portion includes:

a third portion which surrounds the second connecting portions; and a fourth portion which is adjacent to the third portion and which surrounds the cable exposed portion, and a thickness of the third portion of the solid insulating material is different from a thickness of the fourth portion of the solid insulating material.

7. A connector assembly comprising:

a connector including contact terminals:

a cable including conductors; and a wiring board which electrically connects the connector and the cable, wherein the wiring board includes:

first connecting portions which are arranged at a first pitch and to which the contact terminals are electrically connected:

second connecting portions which are arranged at a second pitch and to which the conductors of the cable are electrically connected: and wiring lines which electrically connect the first connecting portions and the second connecting portions, the first pitch is smaller than the second pitch, wherein the cable includes a cable exposed portion in which insulating wires including the conductors are exposed from a cable shielding layer and the conductors are exposed from the insulating wires, the connector assembly further comprises:

a connector shielding layer which is provided around the wiring board and the cable exposed portion; and an insulating material which is interposed between the connector shielding layer and the wiring board and which is the interposed between the connector shielding layer and the cable exposed portion, a distance from the connector shielding layer to the first connecting portions is different from a distance from the connector shielding layer to the second connecting portions and the cable exposed portion, and a portion of the connector shielding layer which faces the first connecting portions via the insulating material is flat.

8. The connector assembly according to claim 7, wherein a distance from the connector shielding layer to the second connecting portions is different from a distance from the connector shielding layer to the cable exposed portion.

* * * * *